US007275396B2

(12) United States Patent
MacHock

(10) Patent No.: US 7,275,396 B2
(45) Date of Patent: Oct. 2, 2007

(54) APPARATUS AND METHOD OF SUPPORTING AN EARRING

(76) Inventor: Karen Hinz MacHock, 4036 Costado Pl., Pebble Beach, CA (US) 93953

( * ) Notice: Subject to any disclaimer, the term of this patent is extended or adjusted under 35 U.S.C. 154(b) by 0 days.

(21) Appl. No.: 11/129,174

(22) Filed: May 13, 2005

(65) Prior Publication Data

US 2006/0081003 A1 Apr. 20, 2006

Related U.S. Application Data

(60) Provisional application No. 60/619,561, filed on Oct. 15, 2004.

(51) Int. Cl.
*A44C 5/00* (2006.01)
*A44C 7/00* (2006.01)
*A44C 25/00* (2006.01)

(52) U.S. Cl. ..... 63/14.1; 63/35; 63/3; 63/3.1; 63/12; 63/3.2; 24/3.13; 24/300; 24/301; 24/298

(58) Field of Classification Search ..... 63/35, 63/3, 1.11, 38, 14.1, 3.1, 12, 3.2, 14.2–14.9; 351/157; D11/40, 26, 42; 24/3.13, 300, 24/301, 298
See application file for complete search history.

(56) References Cited

U.S. PATENT DOCUMENTS

| | | | | | |
|---|---|---|---|---|---|
| 89,452 | A | * | 4/1869 | Weed | 63/14.2 |
| 421,099 | A | * | 2/1890 | Kelley | 351/66 |
| 1,124,518 | A | * | 1/1915 | Qvarnstrom | 24/115 H |
| 1,582,383 | A | * | 4/1926 | Connally | 63/14.2 |
| 1,602,239 | A | * | 10/1926 | Miller | 63/14.2 |
| 1,620,674 | A | * | 3/1927 | Miller | 63/14.2 |
| 1,626,334 | A | * | 4/1927 | Morris | 70/457 |
| 1,732,250 | A | | 10/1929 | Wehse | |
| 1,743,006 | A | * | 1/1930 | Prescott-Richardson | 63/12 |
| 2,009,537 | A | * | 7/1935 | Williams | 63/14.2 |
| 2,034,052 | A | * | 3/1936 | McLeod | 63/14.2 |
| 2,525,195 | A | * | 10/1950 | Austrin et al. | 63/14.2 |
| 2,718,128 | A | * | 9/1955 | Richards | 63/14.2 |
| 3,187,396 | A | * | 6/1965 | Carroll | 24/115 R |
| 3,397,026 | A | * | 8/1968 | Spina | 351/157 |
| 3,813,733 | A | * | 6/1974 | Flohr | 285/117 |
| 3,827,790 | A | * | 8/1974 | Wenzel | 351/123 |
| 3,879,804 | A | * | 4/1975 | Lawrence | 24/3.4 |
| D256,520 | S | * | 8/1980 | DiCarlo et al. | D3/259 |
| 4,317,257 | A | * | 3/1982 | Engel | 452/128 |
| 4,334,413 | A | * | 6/1982 | Gaston et al. | 63/3.2 |
| 4,827,738 | A | * | 5/1989 | Rothal | 63/14.1 |
| D301,700 | S | * | 6/1989 | Coleman | D11/86 |
| 4,965,913 | A | * | 10/1990 | Sugarman | 24/3.3 |
| 4,993,240 | A | * | 2/1991 | Pounder | 63/12 |
| 5,044,176 | A | | 9/1991 | King | |
| 5,184,482 | A | * | 2/1993 | Cloud | 63/14.1 |

(Continued)

FOREIGN PATENT DOCUMENTS

| | | |
|---|---|---|
| DE | 3322082 | 12/1984 |

(Continued)

*Primary Examiner*—J J Swann
*Assistant Examiner*—David C Reese

(57) ABSTRACT

An earring support device constructed of a single length of flexible metal wire or plastic line bent back upon itself at both ends and clasped or otherwise fasted so as to form a large loop at one end and one or more smaller loops at the other end.

19 Claims, 3 Drawing Sheets

U.S. PATENT DOCUMENTS 5,195,335 A * 3/1993 Hart ..... 63/3.2
5,507,075 A * 4/1996 Tillstrom ..... 24/3.3
D388,011 S * 12/1997 Leonard ..... D11/40
5,809,803 A * 9/1998 Stracuzzi ..... 63/12
6,098,250 A * 8/2000 Katz ..... 24/16 PB
6,282,921 B1 9/2001 Carter
6,539,749 B2 * 4/2003 Gibbs, III ..... 63/1.11
6,568,212 B2 * 5/2003 Jacobs ..... 63/12
6,823,565 B2 * 11/2004 Toye ..... 24/265 H
6,854,417 B2 * 2/2005 Stephens ..... 116/238
7,082,788 B1 * 8/2006 Mason ..... 63/13
2003/0200765 A1 10/2003 Lepere

FOREIGN PATENT DOCUMENTS

JP 04008304 1/1992

* cited by examiner

APPARATUS AND METHOD OF SUPPORTING AN EARRING

CROSS REFERENCE TO RELATED APPLICATION

This application claims the benefit of Provisional Patent Application Ser. No. 60/619,561, filed Oct. 15, 2004.

BACKGROUND

1. Field of Invention

This present invention generally relates to an earring support device and a method of making an earring support device. More particularly, the present invention relates to an earring support device that loops over the user's ear to securely support an earring that is suspended from the user's earlobe and a simple method of making such an earring support device.

2. Description of the Prior Art

Pierced, screw-post, and clip-on earrings exert a significant amount of stress on the earlobe(s) of the person wearing them. Typically, the amount of stress on the earlobe(s) increases as the weight of the earring increases. Similarly, the amount of stress on the earlobe(s) will increase as the length of time the earrings are worn increases. These stresses often produce localized pain in the wearer's earlobe and can also cause a tearing of the opening in the wearer's earlobe through which the post or support portion of the earring extends.

While some of the prior art attempted to reduce the stress created by the weight of the earring, most have focused on cradling the earring around the wearer's earlobe or distributing the stress more evenly around the opening in the wearer's earlobe through which the post or support portion of the earring extends. Unlike the present invention, these devices did not contemplate using the structure of the outer ear itself instead of the earlobe to support the weight of the earring. For example, U.S. Pat. No. 5,044,176 (issued to King, 1991), discloses an U-shaped support cradle that fits under and surrounds the lower portion of the user's ear lobe. While this device may reduce some of the stress exerted on the wearer's earlobe, it does not eliminate the stress. Further, while this device may reduce some of the stress exerted on the wearer's earlobe, the additional weight of the cradle may actually increase the stress exerted on the opening in the wearer's earlobe through which the post or support portion of the earring extends. Similarly, U.S. Pat. No. 6,282,921 B1 (issued to Carter, 2001) discloses an U-shaped ear decoration that, while reducing the discomfort caused by action of the earring, does not eliminate the stress exerted on the wearer's earlobe. Further, while this ear decoration may reduce some of the stress exerted on the wearer's earlobe, the additional weight of the U-shaped ear decoration may actually increase the stress exerted on the opening in the wearer's earlobe through which the post or support portion of the earring extends.

The prior art that discloses devices attached to or resting upon the ridge where the outer ear meets the side of the wearer's head contemplates rigid, bulky, unsightly, irritating (to the skin), and non-adjustable devices that must be machine-milled, machine-fabricated, or machine-pressed. For example, U.S. Pat. No. 2,525,195 (issued to V. Austrin et. al., 1947) discloses a support-type device that fits over the wearer's ear but, given that the device's primary and intended object is to prevent the loss of the earring, it provides little actual support for the earring itself and the problem of stress on the wearer's ear lobe(s) remains. Japan Patent No. 04008304 (issued to Setsuko, 1992) discloses an earring with a pendant chain attached to provide support for the screw-post type earring. While the pendant chain provides some support for the screw-post type earring, the chain is actually part of the earring design itself and as such, cannot be detached from the screw-post type earring. Further, the pendant chain is highly visible and cannot be adjusted in length. U.S. Pat. No. 5,809,803 (issued to Stracuzzi, 1998) discloses an earring that fits over the wearer's ear for the stated purpose of suspending an item of ornamentation adjacent to the upper portion of the wearer's ear.

Other prior art such as U.S. Pat. No. 89,452 (issued to Weed, 1869), U.S. Pat. No. 1,732,250 (issued to Wehse, 1928), U.S. Pat. No. 2,009,537 (issued to Williams, 1934), U.S. Pat. No. 4,827,738 (issued to Rothal, 1989), U.S. Pat. No. 5,184,482 (issued to Cloud, 1993), and German Patent DE 3322082 (issued to Roesler, 1984) disclose devices attached to or resting upon the ridge where the outer ear meets the side of the wearer's head. However, unlike the present invention, these devices contemplate an earring suspended from the support device itself rather than the wearer's ear lobe(s). Further, these devices, unlike the present invention, are typically stiff, inflexible, highly visible, not-interchangeable with other earrings, and not adjustable in length.

The present invention contemplates the use of lightweight and flexible off-the-shelf materials that are easily fabricated into an adjustable (in length) device that, when looped around the outer ear and attached to the earring, alleviates the stress exerted on the wearer's earlobe when an earring is mounted thereon and also resists tearing the opening in the wearer's earlobe through which the post or support portion of the earring extends.

OBJECTS AND ADVANTAGES

The present invention has been designed to solve the foregoing problems found in the prior art. Accordingly, the objects and advantages of the present invention are:

(1) To provide an earring support device for use with pierced, screw-post, or clip-on earrings and that reduces the stresses exerted on the wearer's earlobes when the earring is mounted thereon by transferring the weight stress from the earlobe to the ridge formed where the wearer's ear meets the side of the wearer's head.

(2) To provide an independently configured earring support device that is separate and distinct from the earring and may thereby be used interchangeably with any pierced, screw-post, or clip-on earring.

(3) To provide an earring support device that is made of lightweight, flexible, material and that can be easily hidden at the wearer's discretion.

(4) To provide an earring support device that is simple and inexpensive to manufacture using readily available off-the-shelf materials.

(5) To provide an earring support device that can be made from any number of lightweight, flexible materials.

(6) To provide an earring support device that also provides the wearer with an extra measure of security against accidental loss.

(7) To provide an earring support device that is adjustable in length so that it may conform to the size of a particular wearer's ears.

(8) To provide an earring support device that can be adorned so as to be decorative and fashionable as well as functional.

(9) To provide an earring support device that can be used with domestic and international earring designs.

Further objects and advantages are to provide an earring support device that is inexpensive to purchase, that is easy to slip on and off, that is comfortable to wear, and that is easily replaced. Still further objects and advantages of my invention will become apparent from a consideration of the drawings and the ensuing description of the invention.

SUMMARY

In accordance with the present invention, an earring support device comprises a continuous length of generally even-gauge elastic, flexible plastic material having a single large closed loop at one end and one or more small closed loops at the other end.

DRAWINGS

Drawing Figures

REFERENCE NUMERALS IN DRAWINGS

1-Body
2-Bitter end
3-Large loop
4-Small loop
5-Clamping device
6-Bond

DETAILED DESCRIPTION

Description-Preferred Embodiment

Figure 2:
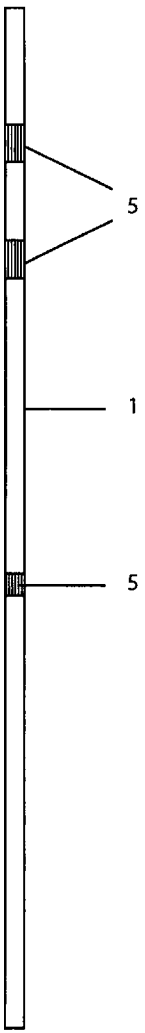
FIG. 2 shows the side view of the preferred embodiment of the Earring Support Device.
Figure 1:
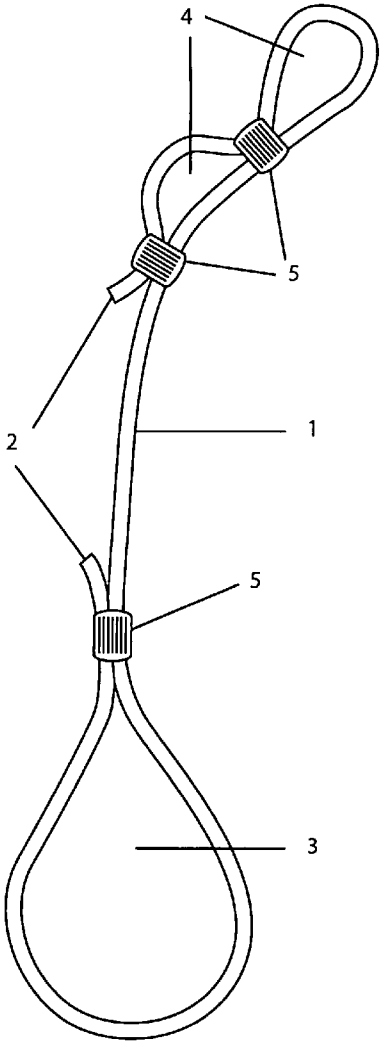
FIG. 1 shows the top view or plan of the preferred embodiment of the Earring Support Device having two small loops.
Figure 4:
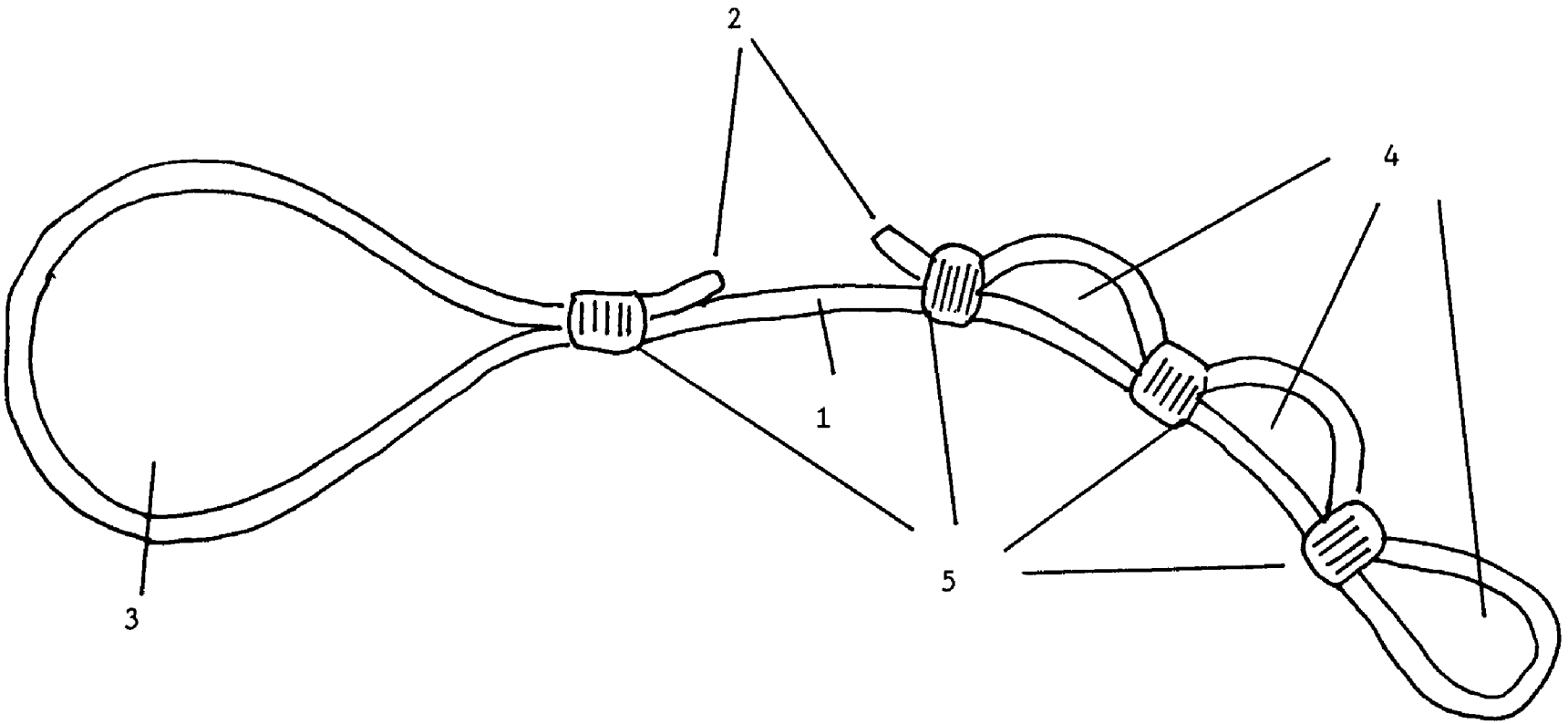
FIG. 4 shows the top view of another embodiment of the Earring Support Device having more than two small loops.
Figure 5:
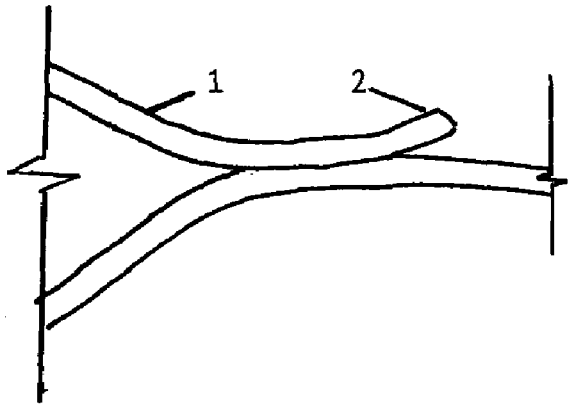
FIG. 5 shows the top view of the Earring Support Device where the loops are secured by means of a bonding agent.
Figure 6:
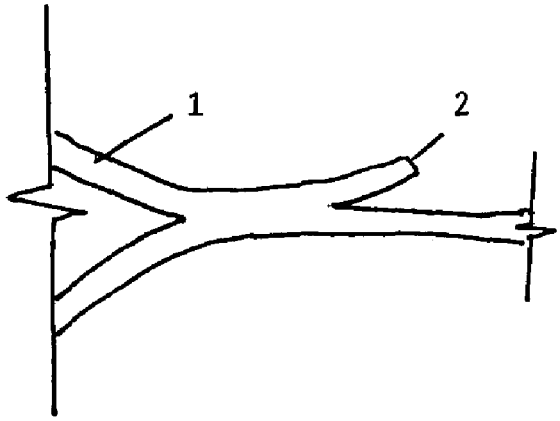
FIG. 6 shows the top view of the Earring Support Device where the loops are secured by means of fusing.
Figure 7:
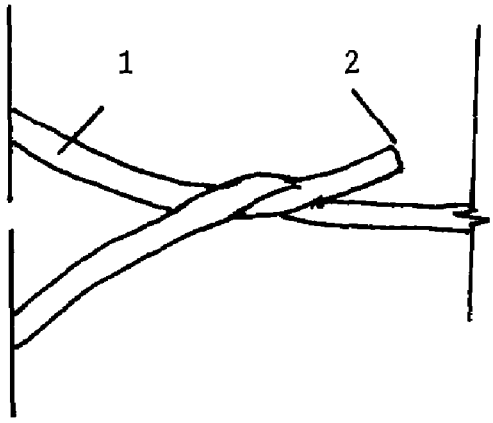
FIG. 7 shows the top view of the Earring Support Device where the loops are secured by means of tying and knotting.

A preferred embodiment of the present invention is illustrated in FIG. 1 (top view) and FIG. 2 (side view). A body 1 is formed from a segment of wire or flexible line of uniform cross section, uniform or composite composition, and typically four to eight inches in length. In the preferred embodiment, said body 1 is a flexible and elastic bead cord such as Elastic City Bead Cord™ which is readily available in jewelry supply stores, hobby shops, etc. However, said body 1 can consist of any other material that can be repeatedly bent without fracturing such as polyethylene, polypropylene, vinyl, nylon, rubber, leather, various fibrous materials, various plasticized materials, nonferrous metals, etc.

A bitter end 2 of said body 1 is bent back upon itself to form a large loop 3 at one end of said body 1 and one or more small loops 4 at the other end of said body 1. A large loop 3 is formed by bending a bitter end 2 back upon said body 1 and attaching said bitter end 2 to said body 1 by means of a clamping device 5 or a bond 6. The diameter of said large loop 3 will vary depending upon the needs of the wearer but is typically between one-half and three-quarters inches in diameter.

Small loops 4 are formed by attaching the other bitter end 2, which is at the opposite end of said body 1, to said body 1 by means of a clamping device 5 or a bond 6 so as to form another large loop 3 and then subdividing said large loop 3 into two or more smaller loops 4 by means of a clamping device 5 or a bond 6. The diameter of the said smaller loops 4 will vary depending upon the needs of the wearer but is typically between one-quarter and a three-eighths inch in diameter.

Clamping devices 5 are cylindrical tubes fabricated from common pliable metals such as brass or silver and having a length of approximately a one-sixteenth inch and an inside diameter slightly larger than twice the diameter of said body 1. Off-the-shelf clamping devices are commercially available and typically sold in jewelry supply stores, beading supply stores, and hobby shops under such brand names as Beadalon® "Crimp Tubes" or "Crimp Beads," but any small diameter cylindrical tube that is pliable enough to collapse upon itself under directly applied pressure from a crimping tool, needle-nose pliers, stylus, or other similar device will suffice. Clamping devices 5 are closed around said body 1 and a bitter end 2 looped back upon said body 1 by means of a crimping tool, needle-nose pliers, stylus, or other similar device.

Bonds 6 consist of any type of off-the-shelf bonding agents sold under brand names such as Miracle-Glue®, Wonder-Glue®, etc. Bonds 6 may also be formed by heating said bitter end 2 and said body 1 to such temperature that both said body 1 and said bitter end 2 fuse with one another. Bonds 6 may also be formed by tying said bitter end 2 in a knot around said body 1. In embodiments where said body 1 has been fabricated from a metal material, said bonds 6 may be also formed by welding or soldering said bitter end 2 to said body 1.

Operation-Preferred Embodiment

In the preferred embodiment of this invention, the "hook" or portion of the earring that extends through the wearer's earlobe is first hooked through a large loop 3 before it is pushed through the front of the wearer's earlobe. After the earring hook has been pushed through the wearer's earlobe and the earring is suspended from the wearer's earlobe, said body 1 is looped around the wearer's outer ear in such a manner that said body 1 lays flat against the wearer's head and rests on the ridge formed by the wearer's ear and the side of the wearer's head. After said body 1 has been looped over the wearer's ear, the wearer will hook a small loop 4 over that portion of the earring that has extended through the wearer's earlobe and is now protruding from the rear of the wearer's earlobe. The wearer can choose from one of several small loops 4 depending upon the size of the wearer's ear and then position said body 1 against the side of the head for comfort and appearance.

In this configuration, the weight of the earring is no longer carried by the earlobe. Instead, the weight is transferred by said body 1 to the ridge formed by the wearer's ear and the side of the wearer's head.

It should be further understood that variations, modifications and special adaptations of this embodiment may be utilized without departing from the scope of the present invention as set forth in the following claims.

Description-Alternative Embodiment

Figure 3:
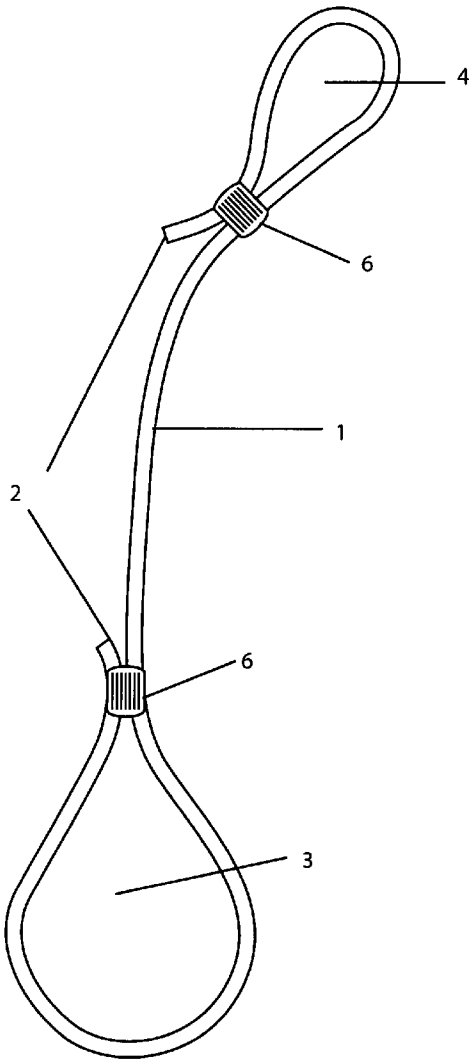
FIG. 3 shows the top view of another embodiment of the Earring Support Device having one small loop.

An alternative embodiment of the present invention is illustrated in FIG. 3. A body 1 is formed from a segment of wire or flexible line of uniform cross section, uniform or composite composition, and typically four to eight inches in length. As with the preferred embodiment, said body 1 of this embodiment is a flexible and elastic bead cord such as Elastic City Bead Cord™ which is readily available in jewelry supply stores, hobby shops, etc. However, said body 1 can consist of any other material that can be repeatedly bent without fracturing such as polyethylene, polypropylene, vinyl, nylon, rubber, leather, various fibrous materials, various plasticized materials, nonferrous metals, etc.

In this embodiment, bitter end 2 of said body 1 is bent back upon itself to form a large loop 3 at one end of said body 1 and one smaller loop 4 at the other end of said body 1. A large loop 3 is formed by bending a bitter end 2 back upon said body 1 and attaching said bitter end 2 to said body 1 by means of a clamping device 5 or a bond 6. The diameter of said large loop 3 will vary depending upon the needs of the wearer but is typically between one-half and three-quarters inches in diameter.

Small loop 4 is formed by attaching the other bitter end 2, which is at the opposite end of said body 1, to said body 1 by means of a clamping device 5 or a bond 6. The diameter of said smaller loop 4 will vary depending upon the needs of the wearer but is typically between one-quarter and three-eighths inches in diameter.

As with the preferred embodiment, clamping devices 5 for this alternative embodiment are cylindrical tubes fabricated from common pliable metals such as brass or silver and having a length of approximately a one-sixteenth inch and an inside diameter slightly larger than twice the diameter of said body 1. Off-the-shelf clamping devices are commercially available and typically sold in jewelry supply stores, beading supply stores, and hobby shops under such brand names as Beadalon® "Crimp Tubes" or "Crimp Beads," but any small diameter cylindrical tube that is pliable enough to collapse upon itself under directly applied pressure from a crimping tool, needle-nose pliers, stylus, or other similar device will suffice. Clamping devices 5 are closed around said body 1 and a bitter end 2 looped back upon said body 1 by means of a crimping tool, needle-nose pliers, stylus, or other similar device.

Bonds 6 consist of any type of off-the-shelf bonding agents sold under brand names such as Miracle-Glue®, Wonder-Glue®, etc. Bonds 6 may also be formed by heating said bitter end 2 and said body 1 to such temperature that both said body 1 and said bitter end 2 fuse with one another. Bonds 6 may also be formed by tying said bitter end 2 in a knot around said body 1. In embodiments where said body 1 has been fabricated from a metal material, said bonds 6 may be also formed by welding or soldering said bitter end 2 to said body 1.

Operation-Alternative Embodiment

In this alternative embodiment of the present invention, the "hook" or portion of the earring that extends through the wearer's earlobe is first hooked through a large loop 3 before it is pushed through the front of the wearer's earlobe. After the earring hook has been pushed through the wearer's earlobe and the earring is suspended from the wearer's earlobe, said body 1 is looped around the wearer's outer ear in such a manner that said body 1 lays flat against the wearer's head and rests on the ridge formed by the wearer's ear and the side of the wearer's head. After said body 1 has been looped over the wearer's ear, the wearer will hook small loop 4 over that portion of the earring that has extended through the wearer's earlobe and is now protruding from the rear of the wearer's earlobe.

In this configuration, as with the preferred embodiment, the weight of the earring is no longer carried by the earlobe. Instead, the weight is transferred by said body 1 to the ridge formed by the wearer's ear and the side of the wearer's head.

It should be further understood that variations and modifications and special adaptations of this embodiment may be utilized without departing from the scope of the present invention as set forth in the following claims.

CONCLUSION, RAMIFICATIONS, AND SCOPE

Accordingly, the reader will see that the earring support device of this invention can be used to easily and conveniently support any type of earring(s) in such a manner as to relieve the stress on the wearer's earlobes caused by the weight of the earring(s). The earring support device of this invention will be inexpensive to purchase, easy to slip on and off, comfortable to wear, and easily replaced should it be lost. Furthermore, the earring support device of this invention has the additional advantages in that:

- it can be used with pierced, screw-post, or clip-on earrings;
- it reduces the stresses exerted on the wearer's earlobes when an earring is mounted thereon by transferring the weight stress from the earlobe to the ridge where the wearer's ear meets the wearer's head;
- it is separate and distinct from the earring and may thereby be used interchangeably with any pierced, screw-post, or clip-on earring;
- it can be made of lightweight, flexible, material;
- it can be easily hidden at the wearer's discretion;
- it is simple and inexpensive to manufacture using readily available off-the-shelf materials;
- it can be made from any number of lightweight, flexible materials;
- it provides the wearer with an extra measure of security against accidental loss;
- it is adjustable in length so that it may conform to the size of a particular wearer's ears;
- it can be adorned so as to be decorative and fashionable as well as functional;
- it can be used with domestic and international earring designs.

Although the description above contains many specificities, these should not be construed as limiting the scope of the invention but as merely providing illustrations of some of the presently preferred embodiments of this invention. For example, the loops can have different shapes such as circular, oval, etc.; the clamping device can be configured to be ornamental as well as functional; the plastic line can be transparent, translucent, opaque, colorless, tinted, or colored.

Thus the scope of the invention should be determined by the appended claims and their legal equivalents, rather than bty the examples given.

I claim:

1. A support device for an earring adapted to encircle a wearer's ear and is connected to said earring on both sides of a wearer's ear lobe when in use, transferring said earring's weight from said ear lobe to a ridge formed by said wearer's ear and a side of said wearer's head, comprising a continuous length of flexible material having a single large closed nonadjustable loop at one end and two or more small closed nonadjustable loops at the other end, a. said large closed nonadjustable loop being formed when one bitter end of said flexible material is folded back upon itself and secured to said flexible material by means of a clamping device sheathed around said flexible material and said bitter end, b. said two or more small closed nonadjustable loops being formed when an opposite bitter end of said flexible material is folded back upon itself and secured to said flexible material by means of two or more clamping devices sheathed around said flexible material and said opposite bitter end so as to bind opposing interior sides of said opposite bitter end and said flexible material, c. said clamping device being a cylindrical metallic tube with an inside diameter slightly greater than twice the diameter of said flexible material and thin enough to collapse against said flexible material and said bitter ends so as to secure said bitter end against said flexible material when said clamping device is squeezed with a crimping tool, needle-nose pliers, stylus, or other such similar device.

2. The earring support device as claimed in claim 1 wherein said large closed nonadjustable loop and said two or more small closed nonadjustable loops are formed by securing said bitter ends to said flexible material by means of a bonding agent.

3. The earring support device as claimed in claim 1 wherein said large closed nonadjustable loop and said two or more small closed nonadjustable loops are formed by securing said bitter ends to said flexible material by fusing said bitter ends to said flexible material by means of a thermal process.

4. The earring support device as claimed in claim 1 wherein said large closed nonadjustable loop and said two or more small closed nonadjustable loops are formed by tying and knotting said bitter ends to said flexible material.

5. The earring support device claimed in claim 1 wherein said support device is fabricated from a continuous length of generally even-gauge and flexible metal wire material.

6. The earring support device as claimed in claim 5 wherein said large closed nonadjustable loop and said two or more small closed nonadjustable loops are formed by securing said bitter ends to said generally even-gauge and flexible metal wire material by means of a bonding agent.

7. The earring support device as claimed in claim 5 wherein said large closed nonadjustable loop and said two or more small closed nonadjustable loops are formed by securing said bitter ends to said generally even-gauge and flexible metal wire material by fusing said bitter ends to said generally even-gauge and flexible metal wire material by means of a thermal process.

8. The earring support device as claimed in claim 5 wherein said large closed nonadjustable loop and said two or more small closed nonadjustable loops are formed by tying and knotting said bitter ends to said generally even-gauge and flexible metal wire material.

9. The earring support device claimed in claim 1 wherein said support device is fabricated from a continuous length of generally even-gauge and flexible plastic material.

10. The earring support device as claimed in claim 9 wherein said large closed nonadjustable loop and said two or more small closed nonadjustable loops are formed by securing said bitter ends to said generally even-gauge and flexible plastic material by means of a bonding agent.

11. The earring support device as claimed in claim 9 wherein said large closed nonadjustable loop and said two or more small closed nonadjustable loops are formed by securing said bitter ends to said generally even-guage and flexible plastic material by fusing said bitter ends to said even-gauge and flexible plastic material by means of a thermal process.

12. The earring support device as claimed in claim 9 wherein said large closed nonadjustable loop and said two or more small closed nonadjustable loops are formed by tying and knotting said bitter ends to said generally even-gauge and flexible plastic material.

13. A support device for an earring adapted to encircle a wearer's ear and is connected to said earring on both sides of a wearer's ear lobe when in use, transferring said earring's weight from said ear lobe to a ridge formed by said wearer's ear and a side of said wearer's head, comprising a continuous length of flexible material having a single large closed nonadjustable loop at one end and a single smaller closed nonadjustable loop at the other end, a. said large closed nonadjustable loop being formed when one bitter end of said flexible material is folded back upon itself and secured to said flexible material by means of a clamping device sheathed around said flexible material and said bitter end, b. said smaller closed nonadjustable loop being formed when an opposite end of said flexible material is folded back upon itself and secured to said flexible material by means of a clamping device sheathed around said flexible material, c. said clamping device being a cylindrical metallic tube with an inside diameter slightly greater than twice the diameter of said flexible material and thin enough to collapse against said flexible material and said bitter ends so as to secure said bitter end against said flexible material when said clamping device is squeezed with a crimping tool, needle-nose pliers, stylus, or other such similar device.

14. The earring support device as claimed in claim 13 wherein said large closed nonadjustable loop and said smaller closed nonadjustable loop are formed by securing said bitter ends to said flexible material by means of a bonding agent.

15. The earring support device as claimed in claim 13 wherein said large closed nonadjustable loop and said smaller closed nonadjustable loop are formed by securing said bitter ends to said flexible material by fusing said bitter ends to said flexible material by means of a thermal process.

16. The earring support device as claimed in claim 13 wherein said large closed nonadjustable loop and said smaller closed nonadjustable loop are formed by tying and knotting said bitter ends to said flexible material.

17. The earring support device claimed in claim 13 wherein said support device is fabricated from a continuous length of generally even-gauge and flexible metal wire material.

18. The earring support device claimed in claim 13 wherein said support device is fabricated from a continuous length of generally even-gauge and flexible plastic material.

19. A method of fabricating an support device for an earring adapted to encircle a wearer's ear and is connected to said earring on both sides of a wearer's ear lobe when in use, transferring said earring's weight from said ear lobe to a ridge formed by said wearer's ear and a side of said wearer's head, comprising the steps of, a. folding one bitter end of a continuous length of material from which said earring support device is fabricated back upon itself so as to form a small nonadjustable loop, b. securing said bitter end to said continuous length of material, c. folding an opposite bitter end of said continuous length of material back upon itself so as to form a larger nonadjustable loop greater in diameter than said small nonadjustable loop, and d. securing said opposite bitter end to said continuous length of material.

* * * * *